US009557076B2

(12) United States Patent
Kusachi et al.

(10) Patent No.: US 9,557,076 B2
(45) Date of Patent: Jan. 31, 2017

(54) HOT WATER SUPPLY APPARATUS AND CONTROL METHOD THEREOF

(71) Applicant: NORITZ CORPORATION, Hyogo (JP)

(72) Inventors: Rena Kusachi, Kobe (JP); Yuki Maeshima, Kako-gun (JP); Hiroki Nabeshima, Akashi (JP); Kenichi Nakayama, Akashi (JP)

(73) Assignee: NORITZ CORPORATION, Hyogo (JP)

( * ) Notice: Subject to any disclaimer, the term of this patent is extended or adjusted under 35 U.S.C. 154(b) by 379 days.

(21) Appl. No.: 14/149,661

(22) Filed: Jan. 7, 2014

(65) Prior Publication Data

US 2014/0202679 A1 Jul. 24, 2014

(30) Foreign Application Priority Data

Jan. 18, 2013 (JP) ..... 2013-007242

(51) Int. Cl.
*F24H 9/20* (2006.01)
*F24H 1/14* (2006.01)

(52) U.S. Cl.
CPC ..... *F24H 9/2035* (2013.01); *F24H 1/145* (2013.01)

(58) Field of Classification Search
CPC ..... G06F 1/206; G06F 1/20; G05D 23/1917; F24H 9/2035; F24H 1/145
(Continued)

(56) References Cited

U.S. PATENT DOCUMENTS

2004/0144528 A1* 7/2004 Kunimoto ..... F24D 17/02 165/298
2009/0159017 A1* 6/2009 Tsuge ..... F24D 19/1051 122/14.1
(Continued)

FOREIGN PATENT DOCUMENTS

JP 01-118061 A 5/1989
JP H02-223765 A 9/1990
(Continued)

OTHER PUBLICATIONS

A Notice of Allowance; "Decision to Grant Patent," issued by the Japanese Patent Office on Oct. 25, 2016, which corresponds to Japanese Patent Application No. 2013-007242 and is related to U.S. Appl. No. 14/149,661; with English language translation.

*Primary Examiner* — Robert Fennema
*Assistant Examiner* — Jigneshkumar Patel
(74) *Attorney, Agent, or Firm* — Studebaker & Brackett PC

(57) ABSTRACT

By a feedback arithmetic operation based on a temperature deviation, an input number is set which corresponds to a requested heat quantity generation, which is a controlled object, to a hot water supply apparatus. The temperature deviation is calculated by correcting a deviation of a tapping temperature with respect to a set hot water temperature with use of a Smith compensation temperature calculated by a Smith compensator for predicting a variation in a tapping temperature prior to an elapse of a dead time corresponding to a detection lag of the tapping temperature. The Smith compensator calculates a Smith compensation temperature to be used in the next control cycle based on the input scale number, the present Smith compensation temperature, and a time constant set in accordance with a flow rate of the hot water supply apparatus.

8 Claims, 6 Drawing Sheets

(58) Field of Classification Search
USPC ..... 700/300
See application file for complete search history.

(56) References Cited

U.S. PATENT DOCUMENTS

| | | | | |
|---|---|---|---|---|
| 2012/0046801 | A1* | 2/2012 | Mori | F24H 1/145 700/300 |
| 2013/0025301 | A1* | 1/2013 | Maitani | F24D 11/0214 62/79 |

FOREIGN PATENT DOCUMENTS

| | | | |
|---|---|---|---|
| JP | 04-303201 | A | 10/1992 |
| JP | H05-59156 | U | 8/1993 |
| JP | 07-013543 | B2 | 2/1995 |
| JP | H09-96415 | A | 4/1997 |
| JP | H09-97119 | A | 4/1997 |
| JP | 10-141767 | A | 5/1998 |

* cited by examiner

HOT WATER SUPPLY APPARATUS AND CONTROL METHOD THEREOF

BACKGROUND OF THE INVENTION

Field of the Invention

The present invention relates to a hot water supply apparatus, and more particularly to a hot water temperature control of a hot water supply apparatus.

Description of the Background Art

Japanese Examined Patent Application Publication No. 7-13543 and Japanese Patent Laying-Open No. 10-141767 disclose hot water supply apparatuses in which a fuel supply amount to a burner of a hot water dispenser is adjusted by a feedback control so as to compensate for a deviation of a tapping temperature with respect to a set hot water temperature.

Further, Japanese Patent Laying-Open No. 4-303201 discloses that a control apparatus using a Smith controller for controlling a controlled object including a dead time is applied to a hot water supply system.

SUMMARY OF THE INVENTION

According to the control apparatus of the hot water supply system disclosed in Japanese Patent Laying-Open No. 4-303201, a configuration of a transfer function-based control system is merely disclosed, and it is not sufficiently disclosed how actual control arithmetic processing is executed.

On the other hand, in the case of achieving the control system actually with use of a microcomputer and the like, it is necessary to allow execution of the control arithmetic processing for applying the Smith method while taking in consideration that an arithmetic load and a storage capacity do not become too large.

The present invention was achieved to solve the problem described above, and its object is to execute arithmetic processing for a hot water temperature control of a hot water supply apparatus applied with the Smith method without rendering the arithmetic load and the required storage capacity to be too large.

According to one aspect of the present invention, a hot water supply apparatus includes a heat exchanger configured to heat passing water by means of a heat quantity generated by a heat source mechanism, a temperature detector arranged on a downstream side of the heat exchanger, a flow rate detector for detecting a passing flow rate of the heat exchanger, and control apparatus. The control apparatus controls for each predetermined control cycle the heat quantity generated by the heat source mechanism based on a tapping temperature detected by the temperature detector and a set temperature of the tapping temperature. The control apparatus includes a temperature estimating unit and a feedback control unit. The temperature estimating unit estimates for each of the control cycle a compensation temperature for compensating for a detection lag of a tapping temperature by the temperature detector with respect to an output temperature of the heat exchanger. The feedback control unit sets a requested heat quantity generation to the heat source mechanism based on a temperature deviation which is calculated by correcting a deviation between a tapping temperature detected by the temperature detector and the set temperature with use of the compensation temperature. The temperature estimating unit is configured to set a time constant of a first order lag of a change in the compensation temperature with respect to a change in the requested heat quantity generation in accordance with the passing flow rate detected by the flow rate detector. The temperature estimating unit is further configured to calculate the compensation temperature for a next control cycle based on the compensation temperature, the requested heat quantity generation, and the set time constant which are at a present control cycle.

According to another aspect of the present invention, a control method of a hot water supply apparatus including a heat exchanger configured to heat passing water by means of a heat quantity generated by a heat source mechanism includes the steps of detecting a passing flow rate of the heat exchanger, detecting a tapping temperature based on an output of a temperature detector arranged on a downstream side of the heat exchanger, estimating for each of a control cycle a compensation temperature for compensating for a detection lag of said tapping temperature by said temperature detector with respect to an output temperature from the heat exchanger, calculating a temperature deviation, and setting a requested heat quantity generation to the heat source mechanism. The temperature deviation is calculated by correcting a deviation between a set temperature of the tapping temperature and a detected temperature by said temperature detector with use of said compensation temperature. The requested heat quantity generation to the heat source mechanism is set for each of the control cycle based on said temperature deviation. The step of estimating includes the steps of setting a time constant of a first order lag of a change in the compensation temperature with respect to a change in the requested heat quantity generation in accordance with said detected passing flow rate, and calculating said compensation temperature for a next control cycle based on the compensation temperature, the requested heat quantity generation, and the set time constant which are at a present control cycle.

In the hot water supply apparatus and the control method thereof described above, a compensation temperature for compensating for a detection lag of a tapping temperature by a temperature detector with respect to an output temperature of a heat exchanger can be calculated with use of a simple arithmetic operation for calculating a variation in compensation temperatures during control cycles without storing a history of operation inputs (requested heat quantity generations) by control apparatus from starting of the control to a present time point. Consequently, a hot water temperature control of a hot water supply apparatus applied with the Smith method can be executed without rendering an arithmetic load and a required storage capacity to be too large. Particularly, an accuracy of the compensation temperature can be enhanced also with use of the simple arithmetic operation described above by setting a time constant of a first order lag in calculation of the compensation temperature in accordance with a flow rate of the heat exchanger.

As described above, the major effect of the present invention is in that the arithmetic processing for the hot water temperature control of the hot water supply apparatus applied with the Smith method can be executed without rendering the arithmetic load and the required storage capacity to be too large.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Hereinafter, an embodiment of the present invention will be described in detail with reference to the drawings.

Figure 1:
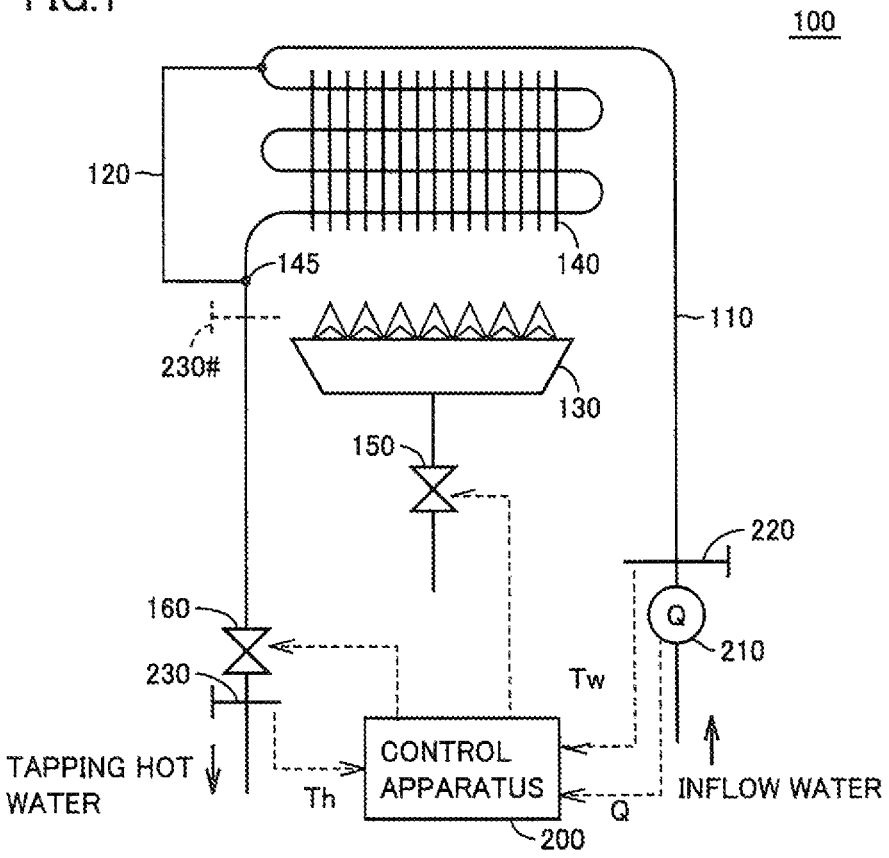
FIG. 1 schematically represents a configuration of a hot water supply apparatus according to an embodiment of the present invention.

FIG. 1 schematically represents a hot water supply apparatus according to the embodiment of the present invention.

Referring to FIG. 1, a hot water supply apparatus 100 according to the embodiment of the present invention includes a hot water supply pipe 110, a bypass pipe 120, a gas burner 130, a heat exchanger 140, a gas proportional valve 150, a flow rate adjusting valve 160, and a control apparatus 200.

Hot water supply pipe 110 is configured to provide a connection from a water inlet to a hot water outlet. Flow rate adjusting valve 160 is interposed and connected to hot water supply pipe 110. Control apparatus 200 is able to control a tapping amount by adjusting a degree of opening of flow rate adjusting valve 160.

Gas burner 130 combusts a mixture of gas supplied from a gas pipe (not illustrated in the drawings) and air supplied from a combustion fan (not illustrated in the drawing) to generate a heat quantity. A pressure of gas supplied to gas burner 130 (in other words, a gas supply amount per unit time) is controlled in accordance with a degree of opening of gas proportional valve 150. The amount of air supplied from the combustion fan is controlled so that an air-fuel ratio in combustion at gas burner 130 is maintained to be constant.

The heat quantity generated by the combustion at gas burner 130 passes through heat exchanger 140 and is used for raising the temperature of water flowing through hot water supply pipe 110. Hot water supply apparatus 100 illustrated in FIG. 1 is configured to mix an output of heat exchanger 140 and an output of bypass pipe 120, which is adapted for not allowing water to pass through heat exchanger 140, and tap hot water.

Hot water supply pipe 110 is provided with a flow rate sensor 210 and temperature sensors 220, 230. Flow rate sensor 210 detects a flow rate Q of hot water supply pipe 110. Temperature sensor 220 is provided on an upstream side of heat exchanger 140 to detect an inflow water temperature Tc. Temperature sensor 230 is provided on a downstream side of heat exchanger 140 to detect a tapping temperature Th. Detected flow rate Q, inflow water temperature Tc, and tapping temperature Th are inputted to control apparatus 200. In other words, temperature sensor 230 corresponds to one example of a "temperature detector".

Control apparatus 200 is configured with, for example, a microcomputer or the like and executes a hot water temperature control for controlling tapping temperature Th in accordance with a set hot water temperature Tr. Specifically, control apparatus 200 is configured to calculate a requested heat quantity generation, which is a heat quantity generated at gas burner 130 required for the hot water temperature control, and control a degree of opening of gas proportional valve 150 in accordance with the requested heat quantity generation. As described above, gas burner 130 is one example of a "heat source mechanism" capable of controlling a generated heat quantity by means of control apparatus 200.

When a generated heat quantity of gas burner 130 is changed, a heat quantity contributing to a rise in water temperature through heat exchanger 140 increases, so that tapping temperature Th is changed. Ideally, a change in tapping temperature Th along with a change in a heat quantity of gas burner 130 can be promptly detected by providing a temperature sensor 230# at a position in proximity to heat exchanger 140.

However, in the example of the configuration of FIG. 1, a hot water temperature is not stabled in the vicinity of a mixing point 145 at which an output from heat exchanger 140 and an output from bypass pipe 120 are mixed. Therefore, in hot water supply apparatus 100, it is necessary to arrange temperature sensor 230 apart from mixing point 145 to some extent.

Thus, tapping temperature Th detected by temperature sensor 230 arranged on a downstream side of heat exchanger 140 has a detection lag with respect to a temperature change corresponding to a change in the requested heat quantity generation to gas burner 130 by the hot water temperature control.

Figure 2:
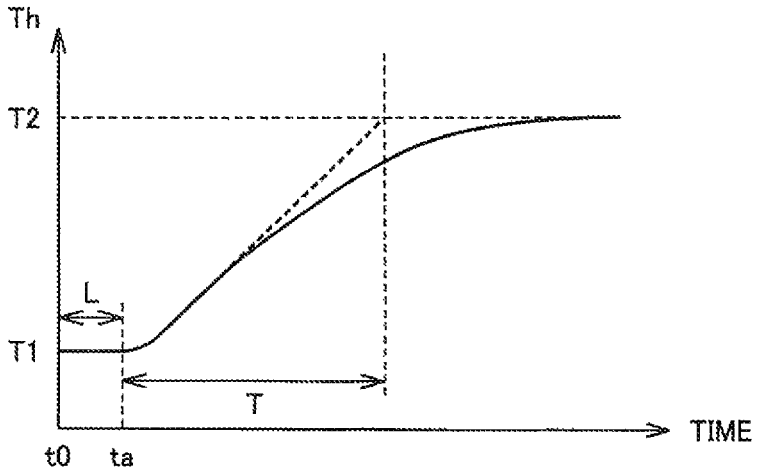
FIG. 2 schematically represents a waveform for describing step response characteristics of the hot water supply apparatus shown in FIG. 1.

FIG. 2 schematically represents a waveform for describing step response characteristics of hot water supply apparatus 100. FIG. 2 shows a transition of tapping temperature Th detected by temperature sensor 230 in the case where the generated heat quantity generated by gas burner 130 is changed in a step-like manner under a constant flow rate.

Referring to FIG. 2, at time t0 where Th=T1, a gas supply pressure to gas burner 130 is increased in a step-like manner. Accordingly, the output temperature from heat exchanger 140 rises. However, since the arranged position of temperature sensor 230 is apart from heat exchanger 140, tapping temperature Th rises from time "ta" which is after an elapse of a predetermined time period from time t0. In the following, a required time L for the temperature change at heat exchanger 140 to be detected by temperature sensor 230 as a change in tapping temperature Th is defined as a dead time L.

From time "ta" with an elapse of dead time L, the rise in the output temperature from heat exchanger 140 on or after time t0 is detected through tapping temperature Th. It should be noted that the temperature change with respect to the change in the generated heat quantity of heat exchanger 140 can be approximated by a first order lag system. In the following, required time T in FIG. 2 for a tangent line of a temperature rise curve at a temperature rise starting (time "ta") point to intersect with a final attainment temperature T2 is defined as a first order lag time T.

In other words, hot water supply apparatus 100 shown in FIG. 1, with the requested heat quantity generation as an input and with tapping temperature Th detected by temperature sensor 230 as an output, can be expressed as a system in which a dead time element (dead time L) and a temperature process element as a first order element (first order lag time T) are connected in series.

Figure 3:
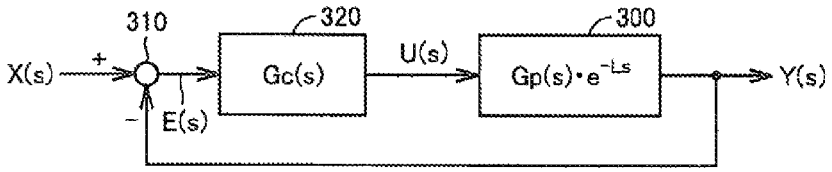
FIG. 3 is a block diagram representing a comparative example of a feedback control system for controlling a tapping temperature of the hot water supply apparatus.

FIG. 3 represents a comparative example of a block diagram representing a hot water temperature control system for controlling tapping temperature Th of hot water supply apparatus 100.

Referring to FIG. 3, a controlled object 300 corresponds to constituting parts of hot water supply apparatus 100 shown in FIG. 1 from which control apparatus 200 is excluded.

A transfer function of controlled object 300 is expressed, as described above, with a product of a dead time element ($e^{-Ls}$) and a temperature process element (Gp(s)).

Herein, since Gp(s) is a first order lag element, it is expressed with the following expression (1) using first order lag time T shown in FIG. 2.

$$Gp(s)=k/(Ts+1) \quad (1)$$

An operation input U(s) to controlled object 300 exhibits a requested heat quantity generation with respect to hot water supply apparatus 100. Further, an output Y(s) of controlled object 300 is tapping temperature Th detected by temperature sensor 230. Generally, in a hot water supply apparatus, the requested heat quantity generation is calculated with a scale number as a unit. The "scale number=1" corresponds to a heat quantity required for raising the hot water temperature by 25° C. under a flow rate of Q=1(L/min). Thus, in the following, the "requested heat quantity generation" as operation input U(s) will also be referred to as an "input scale number". It should be noted that a factor "k" in expression (1) is a conversion factor between the heat quantity (scale number) and the hot water temperature, and is expressed by k=25/Q based on the definition of the scale number described above.

A target value X(s) of controlled object 300 corresponds to set hot water temperature Tr. An arithmetic unit 310 calculates a temperature deviation E(s) of target value X(s) and output Y(s) of controlled object 300. It is expressed by E(s)=Tr−Th.

A controller 320 calculates an input scale number U(s) based on temperature deviation E(s). Controller 320 typically executes a PI feedback control. According to the PI control, a transfer function Gc(s) of controller 320 is expressed by the expression (2).

$$Gc(s)=Kp\cdot E(s)+Ki\cdot(E(s)/s) \quad (2)$$

The first term of expression (2) is an arithmetic term of a proportional control (P control), and the second term is an arithmetic term of an integral control (I control). In expression (2), the "Kp" is a P control gain, and the "Ki" is an I control gain.

Figure 4:
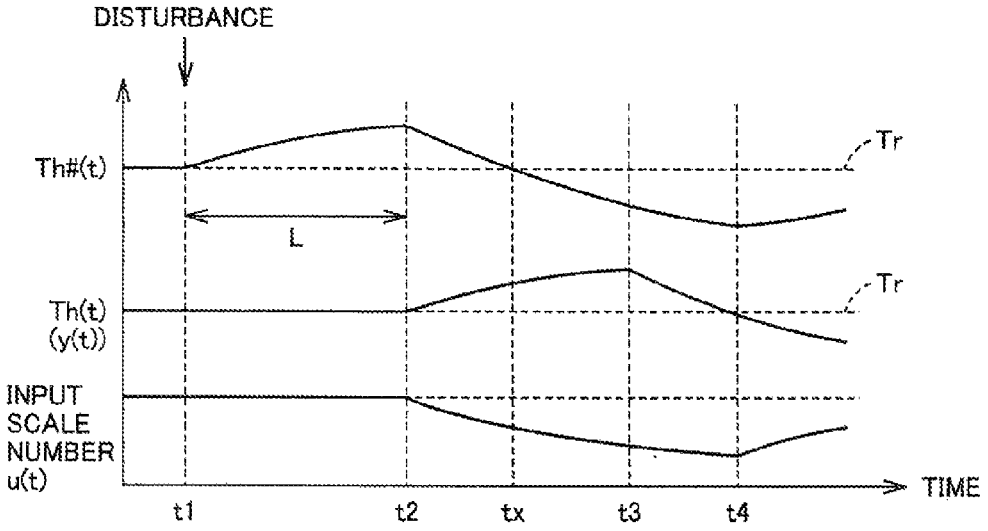
FIG. 4 schematically represents a behavior of a hot water temperature control executed by the feedback control system shown in FIG. 3.

FIG. 4 schematically represents a waveform for describing a behavior of the hot water temperature control executed by the feedback control system shown in FIG. 3. FIG. 4 represents the case where disturbance on a side of temperature rise has occurred at time t1 in the state where tapping temperature Th(t) is stable at set hot water temperature Tr (which is a constant value in FIG. 4).

Referring to FIG. 4, tapping temperature Th#(t) is an imaginary tapping temperature detected by temperature sensor 230# indicated by dotted lines in FIG. 1. In other words, tapping temperature Th#(t) corresponds to the temperature omitting the detection lag due to dead time L from actual tapping temperature Th(t), and corresponds to the output temperature of heat exchanger 140.

Further, actual tapping temperature Th(t) by temperature sensor 230 corresponds to y(t) obtained by converting output Y(s) of FIG. 3 into a time domain. Similarly, u(t) in FIG. 4 represents input scale number U(s) of FIG. 3 in the time domain.

In accordance with the input of disturbance at time t1, tapping temperature Th#(t) rises. However, actual tapping temperature Th(t) does not rise until time t2 after an elapse of dead time L from time t1. When tapping temperature Th(t) rises from time t2, output Y(s) in the feedback control system shown in FIG. 3 rises. Accordingly, controller 320 changes an operation input in the temperature lowering direction. Consequently, input scale number u(t) is lowered from time t2.

However, the change in the tapping temperature due to lowering of input scale number u(t) on or after time t2 is not exhibited in tapping temperature Th until time t3 after an elapse of dead time L from time t2. Therefore, even on or after time "tx" at which tapping temperature Th#(t), in other words, the output temperature of heat exchanger 140 is recovered to set hot water temperature Tr by the feedback control, controller 320 operates to continuously lower input scale number u(t).

On or after time t3, lowering of tapping temperature Th(t) by the effect of the feedback control is detected by temperature sensor 230. Then, at time t4, tapping temperature Th(t) is recovered to set hot water temperature Tr. Consequently, on or after time t4, input scale number u(t) is turned to a change in the temperature rising direction.

However, in this series of control operations, input scale number u(t) continues a change in the temperature lowering direction between times tx and t4 due to influence of dead time L, a significant undershoot occurs at tapping temperature Th#(t). Consequently, the undershoot also occurs at actual tapping temperature Th(t), so that the state where the hot water temperature is lower than set hot water temperature Tr continues for a long period of time.

As described above, with the simple feedback control based on tapping temperature Th(t) detected with dead time L (FIG. 3) included, it is difficult to appropriately execute the hot water temperature control of hot water supply apparatus 100. Particularly, when a feedback gain (Kp and/or Ki) in controller 320 is set to be large, occurrence of overshoot or undershoot is concerned. Therefore, the feedback gain cannot be set so high, and control responsiveness with respect to set hot water temperature Tr is likely to be lowered.

Figure 5:
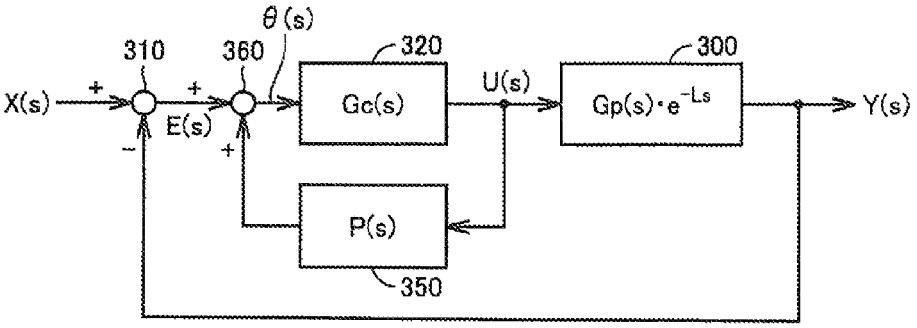
FIG. 5 is a block diagram representing the feedback control system with the Smith method applied to the control system shown in FIG. 3.

As disclosed in Japanese Patent Laying-Open No. 4-303201, application of the Smith method has been conventionally proposed to deal with a controlled object including a dead time. FIG. 5 is a block diagram representing the feedback control system with the Smith method applied to the control system shown in FIG. 3.

Comparing FIG. 5 with FIG. 3, the feedback control system applied with the Smith method further includes a Smith compensator 350 and an arithmetic unit 360 in addition to the control system shown in FIG. 3.

Transfer function P(s) of Smith compensator 350 is expressed by the following expression (3).

$$P(s)=Gp(s)\cdot(e^{-Ls}-1) \tag{3}$$

Smith compensator 350 outputs a product of input scale number U(s) and transfer function P(s) to arithmetic unit 360. Arithmetic unit 360 adds temperature deviation E(s) calculated by arithmetic unit 310 and P(s)·U(s) from Smith compensator 350 to calculate temperature deviation θ(s) corrected by Smith compensation. Controller 320 receives temperature deviation θ(s) corrected by the Smith compensation as an input, not simple temperature deviation E(s).

Herein, since θ(s)=E(s)+P(s)·U(s) is provided, an input to controller 320 is θ(s)=X(s)−Y(s)+P(s)·U(s)=X(s)−(Y(s)−P(s)·U(s)) in the configuration of FIG. 5. In other words, the temperature obtained by correcting the actually detected tapping temperature corrected by −P(s)·U(s) is given as a feedback.

Based on the expression (3), −P(s)·U(s) is expressed by the following expression (4).

$$-P(s)\cdot U(s) = -Gp(s)\cdot U(s)\cdot(e^{-Ls}-1) = Gp(s)\cdot U(s) - Gp(s)\cdot U(s)\cdot e^{-Ls} \tag{4}$$

The first term in expression (4) expresses a predicted value of output Y(s) obtained by inputting input scale number U(s) to temperature process element Gp(s) disregarding dead time L. Further, the second term of expression (4) expresses a variation of output Y(s) obtained by inputting input scale number U(s) to temperature process element (Gp(s)) after an elapse of dead time L.

Consequently, temperature deviation θ(s) is calculated by adding a predicted value of a change in output until an elapse of dead time L to and subtracting a change in output after an elapse of dead time L from actually detected output Y(s). Accordingly, it can be understood that temperature deviation θ(s) inputted to controller 320 exhibits exclusion of influence of dead time L.

Figure 6:
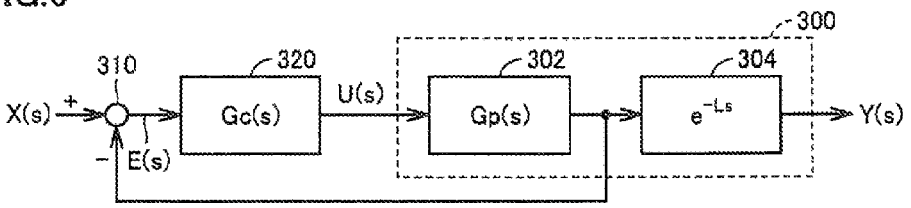
FIG. 6 is an equivalent block diagram of the feedback control system shown in FIG. 5.

Consequently, the control system shown in FIG. 5 is equivalently converted to the feedback control system shown in FIG. 6.

Referring to FIG. 6, controlled object 300 is equivalent to the serial connection of original temperature process element 302 and dead time element 304. Further, with Smith compensator 350 shown in FIG. 5, the feedback control of comparing Gp(s)·U(s) with target value X(s) can be achieved. In other words, controller 320 can set input scale number U(s) with the control arithmetic operation based on the temperature deviation excluding the influence of dead time L (for example, expression (2)).

As can be understood from FIG. 6, a feedback loop excluding the influence of dead time element 304 can be configured by using the Smith method.

Thus, in hot water supply apparatus 100 according to the present embodiment, a hot water temperature control system based on the feedback control system applying the Smith method shown in FIG. 5 is constructed.

Figure 7:
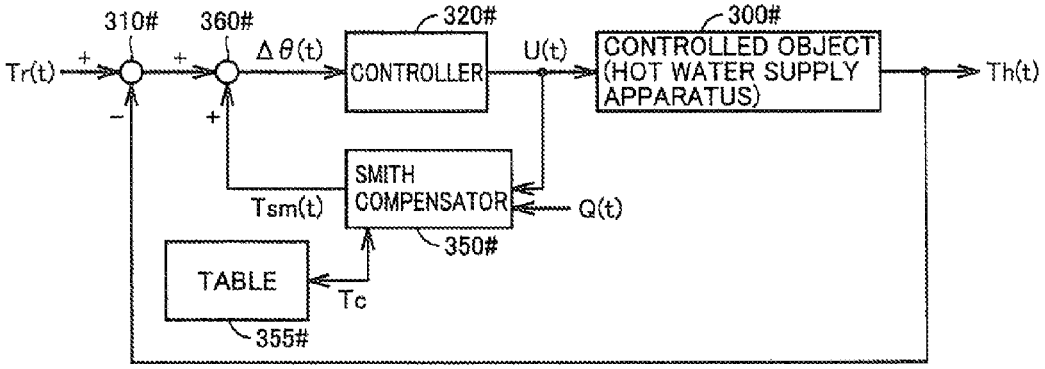
FIG. 7 is a block diagram representing the feedback control system for the hot water temperature control in the hot water supply apparatus according to the embodiment of the present invention.

FIG. 7 is a block diagram representing a hot water temperature control system in the hot water supply apparatus according to the embodiment of the present invention. The control system shown in FIG. 7 represents the block diagram shown in FIG. 5 on the basis of the time domain. Typically, the function of each block shown in FIG. 7 can be achieved by software processing executed by control apparatus 200 shown in FIG. 7.

Referring to FIG. 7, the hot water temperature control system of hot water supply apparatus 100 according to the present embodiment includes arithmetic units 310#, 360#, a Smith compensator 350#, and a controller 320#. Similarly to FIG. 3 and the like, a controlled object 300# corresponds to the constituting parts of hot water supply apparatus 100 shown in FIG. 1 from which control apparatus 200 represented by the dime domain is excluded.

Controlled object 300# has tapping temperature Th(t) changed in accordance with a change in input scale number u(t). Since tapping temperature Th(t) is a detected value provided by temperature sensor 230, the change in tapping temperature Th(t) with respect to a change in input scale number u(t) has a first order lag (first order lag time T) and dead time L, as indicated by the step response waveform in FIG. 2.

Arithmetic unit 310# calculates a deviation of tapping temperature Th(t) with respect to set hot water temperature Tr(t). Arithmetic unit 360# adds up an output of arithmetic unit 310# and a Smith compensation temperature Tsm(t) outputted from Smith compensator 350# to calculate temperature deviation Δθ(t). Controller 320# sets input scale number u(t) of hot water supply apparatus 100 (controlled object 300#) in accordance with the feedback arithmetic operation (typically, the P control or the PI control) based on temperature deviation Δθ(t) from arithmetic unit 360#.

Function p(t) of the time domain of Smith compensator 350# can be calculated in the manner as shown in the following expression (5) by applying the inverse Laplace transform to transfer function P(s) shown in expression (3).

$$p(t) = \mathcal{L}^{-1}\{P(s)\} = \mathcal{L}^{-1}\{G_p(s)(e^{-Ls}-1)\} = \mathcal{L}^{-1}\left\{\frac{k}{Ts+1}(e^{-Ls}-1)\right\} = \begin{cases} -\frac{k}{T}e^{-\frac{t}{T}} & (t<L) \\ \frac{k}{T}(e^{\frac{L}{T}}-1)e^{-\frac{t}{T}} & (t>L) \end{cases} \tag{5}$$

Further, Tsm outputted from Smith compensator 350 can be calculated by applying the inverse Laplace transform to transfer function P(s)·U(s). In other words, the left side of expression (6) corresponds to Tsm(t).

$$\begin{aligned}\mathcal{L}^{-1}\{P(s)U(s)\} &= \int_0^t p(\tau)u(t-\tau)d\tau \\ &= -\frac{k}{T}\int_o^L e^{-\frac{\tau}{T}}u(t-\tau)d\tau + \frac{k}{T}(e^{-\frac{L}{T}}-1)\int_L^t e^{-\frac{\tau}{T}}u(t-\tau)d\tau \\ &\approx -\frac{k}{T}(\Delta t)\Big\{u(t-\Delta t)e^{-\frac{\Delta t}{T}} + u(t-2\Delta t)e^{-2\frac{\Delta t}{T}} + \ldots + \\ &\quad u\Big(t-\Big(\frac{L}{\Delta t}-1\Big)\Delta t\Big)e^{-(\frac{L}{\Delta t}-1)\frac{\Delta t}{T}} + u\Big(t-\frac{L}{\Delta t}\Delta t\Big)e^{-\frac{L}{\Delta t}\frac{\Delta t}{T}}\Big\} + \\ &\quad \frac{k}{T}(e^{-\frac{L}{T}}-1)(\Delta t)\Big\{u\Big(t-\Big(\frac{L}{\Delta t}+1\Big)\Delta t\Big)e^{-(\frac{L}{\Delta t}+1)\frac{\Delta t}{T}} + \\ &\quad u\Big(t-\Big(\frac{L}{\Delta t}+2\Big)\Delta t\Big)e^{-(\frac{L}{\Delta t}+2)\frac{\Delta t}{T}} + \ldots + u(0+ \\ &\quad \Delta t)e^{-\frac{t}{T}+\frac{\Delta t}{t}} + u(0)e^{-\frac{t}{T}}\Big\}\end{aligned} \tag{6}$$

The Δt in expression (6) represents a control cycle of the feedback control. As one example, while dead time L in hot water supply apparatus 100 is from several seconds to about 20 to 30 seconds, the control cycle is set to be about Δt=100(ms).

In expression (6), it is understood that input scale number u(t) calculated for each Δt is reflected in Tsm(t) while being decreased by xexp(−Δt/T) at each control cycle. Further, the influence of input scale number u(t) prior to the present time point by dead time L is reflected in Tsm(t) with an inverse polarity with respect to the time prior to an elapse of dead time L. This is because, the temperature change predicted in the past is observed with actual output (tapping temperature Th(t)) after an elapse of dead time L, and cancelled out.

As can be understood from expression (6), to configure Smith compensator 350 complying with the theory, it is necessary to accumulate operation inputs from starting of the control to the present time point, in other words, values of input scale numbers u(0) to u(t−Δt). If the arithmetic operation of expression (6) is achieved directly with the control software to configure Smith compensator 350 in the manner described above, the arithmetic load and the storage capacity required for control apparatus 200 are likely to become too large.

Therefore, in the hot water supply apparatus according to the present embodiment, the control arithmetic operation for configuring Smith compensator 350 is in the form of calculating a variation in Smith compensation temperature Tsm between control cycles. Therefore, if a value after an elapse of Δt is calculated for expression (6), the following expression (7) can be obtained.

$$\int_0^{t+\Delta t} p(\tau)u(t+\Delta t-\tau)d\tau = -\frac{k}{T}\int_0^{L} e^{-\frac{\tau}{T}}u(t+\Delta t-\tau)d\tau + \frac{k}{T}(e^{-\frac{L}{T}}-1)\int_L^{t+\Delta t} e^{-\frac{\tau}{T}}u(t+\Delta t-\tau)d\tau \tag{7}$$

After performing arithmetic operation with expression (7), it can be developed as expressed by expression (8). The left sides of expressions (7) and (8) correspond to Tsm(t+Δt).

$$\begin{aligned}\int_0^{t+\Delta t} p(\tau)u(t+\Delta t-\tau)d\tau \approx\ & -\frac{k}{T}(\Delta t)\Big\{u(t)e^{-\frac{\Delta t}{T}} + u(t-\Delta t)e^{-2\frac{\Delta t}{T}} + \ldots + u\Big(t-\Big(\frac{L}{\Delta t}-1\Big)\Delta t\Big)e^{-\frac{L}{\Delta t}\frac{\Delta t}{T}}\Big\} + \\ & \frac{k}{T}(e^{-\frac{L}{T}}-1)(\Delta t) \\ & \Big\{u\Big(t-\frac{L}{\Delta t}\Delta t\Big)e^{-\left(\frac{L}{\Delta t}+1\right)\frac{\Delta t}{T}} + u\Big(t-\Big(\frac{L}{\Delta t}+1\Big)\Delta t\Big)e^{-\left(\frac{L}{\Delta t}+2\right)\frac{\Delta t}{T}} + \\ & u\Big(t-\Big(\frac{L}{\Delta t}+2\Big)\Delta t\Big)e^{-\left(\frac{L}{\Delta t}+3\right)\frac{\Delta t}{T}} + \ldots + u(0+\Delta t)e^{-\frac{t}{T}} - u(0)e^{-\frac{t+\Delta t}{T}}\Big\}\end{aligned} \tag{8}$$

Further, comparing expression (8) with expression (6), the following expression (9) having Tsm(t+Δt) on the left side is provided.

$$\int_0^{t+\Delta t} p(\tau)u(t+\Delta t-\tau)d\tau = e^{-\frac{\Delta t}{T}}\int_0^{t} p(\tau)u(t-\tau)d\tau - \Big(\frac{k\Delta t}{T}e^{-\frac{\Delta t}{T}}\Big)u(t) + \Big(\frac{k\Delta t}{T}e^{-\frac{L}{T}-\left(\frac{L}{\Delta t}+1\right)\frac{\Delta t}{T}}\Big)u\Big(t-\frac{L}{\Delta t}\Delta t\Big) \tag{9}$$

The first term on the right side of expression (9) is obtained by decreasing the Smith compensation temperature in the previous control cycle in accordance with first order lag time T, and corresponds to exp(−Δt/T)×Tsm(t). Further, the second term on the right side corresponds to a variation in a tapping temperature generated by input scale number u(t) after control cycle Δt (the output temperature of heat exchanger 140) and estimated in accordance with first order lag time T. Further, the third term on the right side is the term based on input scale number u(t) prior to the present time point by time longer than or equal to dead time L. In the present embodiment, the third term is disregarded as to the arithmetic expression for configuring Smith compensator 350. Accordingly, the approximate expression of the following expression (10) can be obtained.

$$\int_0^{t+\Delta t} p(\tau)u(t+\Delta t-\tau)d\tau \approx e^{-\frac{\Delta\tau}{T}}\int_0^{t} p(\tau)u(t-\tau)d\tau - \Big(\frac{k\Delta t}{T}e^{-\frac{\Delta t}{T}}\Big)u(t) \tag{10}$$

Figure 8A:
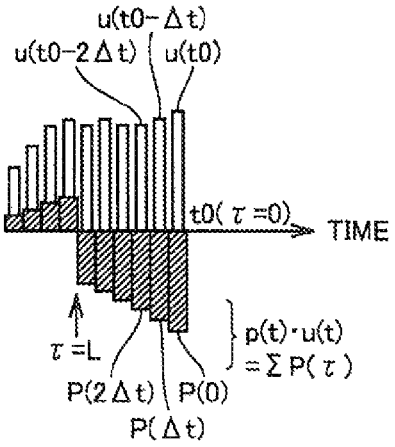
FIG. 8A is a first conceptual diagram for describing an approximate method for deriving an arithmetic expression by a Smith compensator.
Figure 8B:
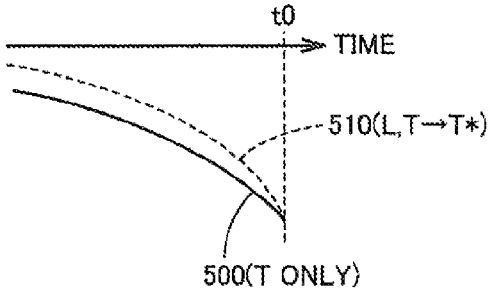
FIG. 8B is a second conceptual diagram for describing the approximate method for deriving the arithmetic expression by the Smith compensator.

FIGS. 8A and 8B are conceptual diagrams for describing an approximate method for deriving expression (10).

In FIG. 8A, input scale numbers u(t) up to present time t0 are shown, and p(t)·u(t) corresponding thereto is shown. In the drawings, p(t)·u(t) is written in P(τ) which is a function of elapsed time "τ" up to present time point. For example, FIG. 8A shows P(0) corresponding to u(t0), P(Δt) corresponding to u(t0−Δt), and P(2Δt) corresponding to u(t0−2Δt).

As shown in expression (6), in the domain of τ<L, P(τ) is decreased at each control cycle Δt in accordance with first order lag time T. Further, in the domain of τ≥L, the polarity of P(τ) is reversed with respect to the domain of τ<L. In the domain of τ≥L, P(τ) is decreased in accordance with dead time L.

According to expression (6), originally, Smith compensation temperature Tsm(t) can be calculated by addition of P(τ) up to the present time point, in other words by addition of p(t)·u(t) in FIG. 8A. However, since the term reflecting the variation at the time of transition from the domain of τ<L to the domain of τ≥A, is disregarded in the approximate expression of expression (10) described above, the domain of τ<L is integrated equivalently.

Therefore, a behavior of the Smith compensation temperature calculated in accordance with expression (10) becomes different from an original behavior of the Smith compensation temperature calculated in accordance with expression (6). Specifically, since the domain of τ≥A, is excluded in the example of FIG. 8A, an absolute value of the Smith compensation temperature becomes greater than original.

In FIG. 8B, numeral 510 denotes the transition of original Smith compensation temperature Tsm(t) obtained by adding up all the domains in accordance with expression (6). On the other hand, numeral 500 denotes the transition of Smith compensation temperature Tsm(t) calculated by adding up only the domain of τ<L in accordance with the approximate expression of expression (10).

Numeral 500 is decreased in accordance with first order lag time T of the temperature process system. On the other hand, numeral 510 is affected by both first order lag time T and dead time L and is decreased at a time constant greater than first order lag time T. Therefore, it is necessary to adjust time constant T in expression (10) so that first order lag time T of the temperature process element is not directly used, and first order lag time T and dead time L of the temperature process element become comprehensively approximate.

In view of the above, in the present embodiment, the approximate expression of the following expression (11) is used as an arithmetic expression used by Smith compensator 350 for each control cycle. It should be noted that expression (11) shows an arithmetic operation of the control cycle at the "n"th number (n: a natural number).

$$Tsm[n] = e^{-\frac{\Delta t}{T^*}} \times Tsm[n-1] - \frac{k\Delta t}{T^*} \times e^{-\frac{\Delta t}{T^*}} \times u[n] \tag{11}$$

As described above, in expression (11), time constant T* for the Smith compensation is used which is different from first order lag time T. In other words, the first term on the right side of expression (11) is obtained by decreasing Smith compensation temperature Tsm[n−1] in the previous control cycle in accordance with time constant T*, and the second term on the right side is obtained by estimating the variation in the tapping temperature (the output temperature of heat exchanger 140) generated by input scale number u[n] after control cycle Δt in accordance with time constant T*. As described above, Tsm[n] is calculated by estimating the temperature change which occurs between the "n"th control cycle and the (n+1)th control cycle based on Tsm[n−1] and u[n]. Time constant T* corresponds to a time constant of the first order lag in a change in Smith compensation temperature Tsm between control cycle (Δt) with respect to a change in the input scale number.

Figure 9:
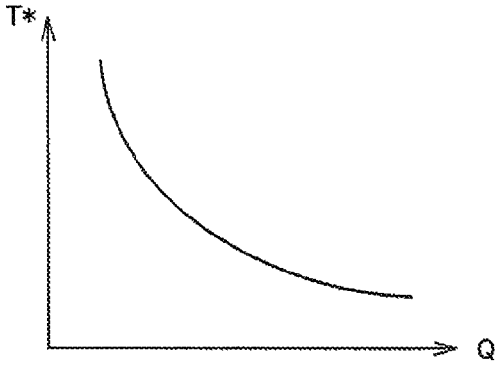
FIG. 9 is a characteristic diagram representing a relationship between a time constant used in the Smith compensator and a flow rate.

For example, as shown in FIG. 9, time constant T* has characteristics that it is lowered as flow rate Q detected by flow rate sensor 210 becomes higher, in other words, as the flow rate of heat exchanger 140 becomes greater, and on the other hand, it rises as flow rate Q becomes lower. Therefore, based on results of on-site experiments and simulation, the characteristics shown in FIG. 9 can be calculated in advance for each kind of hot water supply apparatus. Then, in accordance with the characteristics shown in FIG. 9, function expressions or tables for calculating time constant T* from flow rate Q can be created in advance. In such a manner, the hot water temperature control according to the present embodiment can be applied generally for various different types by switching the tables and function expressions based on the types.

In the example of FIG. 7, a table 355# reflecting the characteristics of FIG. 9 is created in advance, and Smith compensator 350# refers to table 355# using the present flow rate Q(t) so that time constant T* can be set successively. In other words, table 355# corresponds to one example of the "storage unit".

Figure 10:
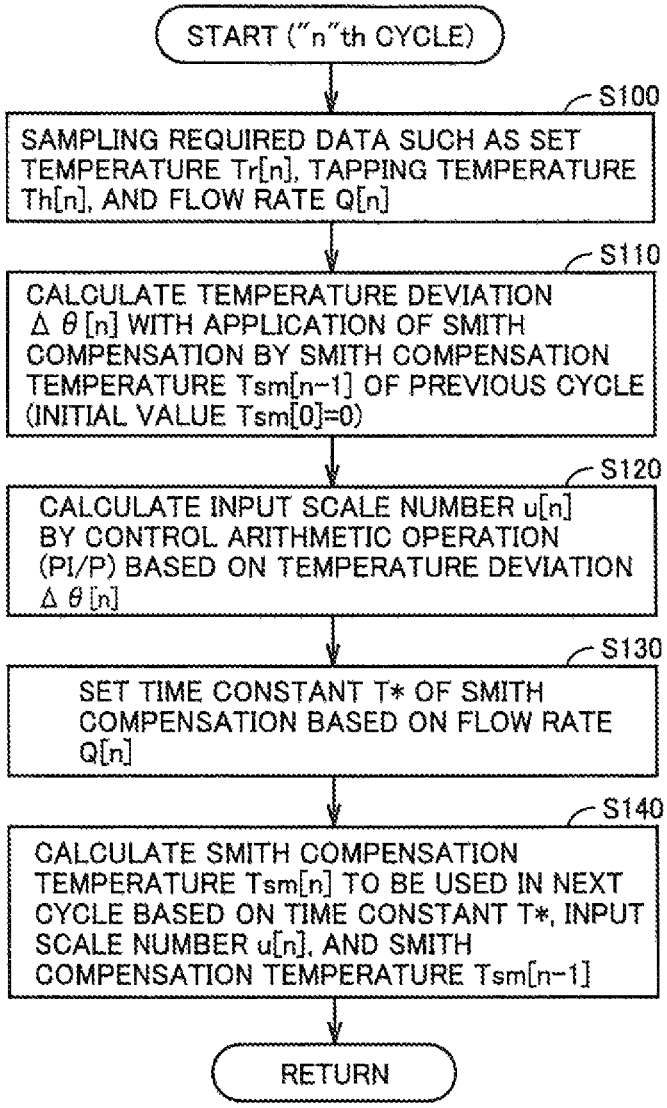
FIG. 10 is a flowchart representing control processing procedures of the hot water temperature control in the hot water supply apparatus according to the embodiment of the present invention.

FIG. 10 is a flowchart representing the control processing procedures of the hot water temperature control executed in the hot water supply apparatus according to the embodiment of the present invention. FIG. 10 represents processing in the "n"th control cycle by the feedback control shown in FIG. 7. The processing is executed by control apparatus 200 at each predetermined control cycle Δt.

Referring to FIG. 10, in step S100, control apparatus 200 samples required data for the control cycle in the present time, specifically, samples set hot water temperature Tr[n], tapping temperature Th[n], and flow rate Q[n].

Then, in step S110, control apparatus 200 calculates temperature deviation Δθ(n) in accordance with the following expression (12) with the Smith compensation using Smith compensation temperature Tsn[n−1] calculated in the previous control cycle. When n=1, an initial value Tsm(0) of the Smith compensation temperature is equal to zero. In hot water supply apparatus 100, the Smith compensation temperature is reset to the initial value at each time when combustion is stopped.

$$\Delta\theta[n] = Tr[n] - (Th[n] - Tsm[n-1]) \tag{12}$$

In other words, by the processing in step S110, the functions of arithmetic units 310# and 360# in FIG. 7 can be achieved. Further, from the expression (12), it can be understood that Smith compensation temperature Tsm[n] calculated by expression (11) is used in the next (n+1)th control cycle.

Further, in step S120, control apparatus 200 sets input scale number u[n] in accordance with the feedback control arithmetic operation result in accordance with the following expression (13) based on temperature deviation Δθ[n] corrected by the Smith compensation.

$$u[n] = Kp \times \frac{\Delta\theta[n]}{25} \times Q[n] + Ki \times \sum_{i=1}^{n} \frac{\Delta\theta[i]}{25} \times Q[n] \tag{13}$$

By the processing in step S120, the function of controller 320# in FIG. 7, in other words, the function corresponding to the "feedback control unit" is achieved. In expression (13), an example of the feedback control arithmetic operation by the PI control is shown. However, the form of the feed back control, such as only the P control or the PID control, is not limited as long as temperature deviation Δθ[n] is used.

In step S130, control apparatus 200 refers to table 355# shown in FIG. 7 to calculate time constant T* used for the Smith compensation in accordance with flow rate Q(n) obtained in step S100. Then, in step S140, control apparatus 200 calculates Tsm[n] used for the arithmetic operation in the next control cycle based on input scale number u[n] and Smith compensation temperature Tsm[n−1] in the previous control cycle and time constant T*. Specifically, Tsm[n] is calculated based on input scale number u[n] calculated in step S120 and Smith compensation temperature Tsm[n−1], in accordance with expression (11) having time constant T* calculated in step S130 and substituted therein.

With the processing of steps S130 and S140, the function of Smith compensator 350# in FIG. 7, in other words, the function corresponding to the "temperature estimating unit" is achieved.

Figure 11:
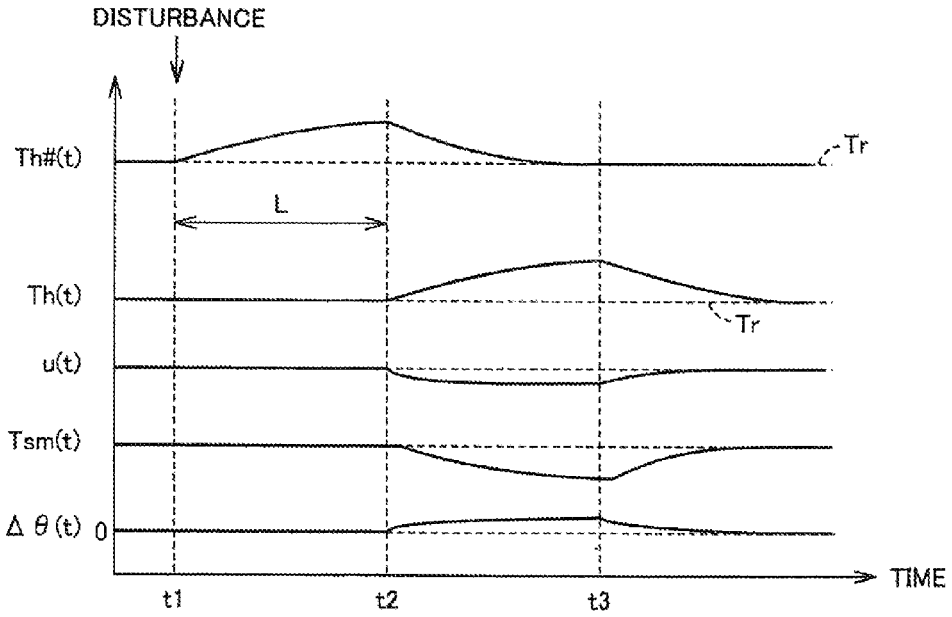
FIG. 11 schematically represents waveforms for describing a behavior of the hot water temperature control of the hot water supply apparatus according to the embodiment of the present invention.

FIG. 11 schematically represents waveforms for describing a behavior of the hot water temperature control in the hot water supply apparatus according to the embodiment of the present invention.

Referring to FIG. 11, similarly to the case of FIG. 4, disturbance on a side of temperature rise occurs at time t1 in the state where tapping temperature Th(t) is stabled at set hot water temperature Tr. In FIG. 11, set hot water temperature Tr is constant.

Due to occurrence of the disturbance, tapping temperature Th# (t) corresponding to the output temperature of heat exchanger 140 rises from time t1. However, tapping temperature Th(t) detected by temperature sensor 230 does not rise until time t2 with an elapse of dead time L from time t1. Thus, input scale number u(t) and Smith compensation temperature Tsm(t) do not change between times t1 and t2.

From time t2, temperature deviation Δθ(t)>0 is provided in the feedback control system shown in FIG. 7 in accordance with the rise in tapping temperature Th(t). Consequently, to lower tapping temperature Th#(t), input scale number u(t) is lowered. As described with reference to FIG. 4, even when input scale number u(t) is lowered from time t2, lowering in tapping temperature Th(t) is detected from time t3 after an elapse of dead time L.

However, in the feedback control system shown in FIG. 7, Smith compensation temperature Tsm(t) is lowered while reflecting lowering in input scale number u(t) also on or before time t3. Consequently, temperature deviation Δθ(t) is calculated to be smaller than simple deviation Th(t)−Tr so as to compensate for the temperature detection lag of tapping temperature Th(t). Accordingly, Th#(t) is appropriately recovered to set hot water temperature Tr without causing undershoot as in the case of FIG. 4.

At or after time t3, an absolute value of Smith compensation temperature Tsm(t) is reduced, thus temperature deviation Δθ(t) is also reduced. Consequently, input scale number u(t) can be changed in the temperature rising direction even in the state where tapping temperature Th(t) is higher than set hot water temperature Tr. Consequently, also as to tapping temperature Th(t), the occurrence of undershoot as in the case of FIG. 4 can be prevented.

As described above, in the hot water supply apparatus according to the present embodiment, by introducing Smith compensator 350#, before a change in a tapping temperature due to a change in an input scale number is detected by temperature sensor 230, the temperature change is predicted, and temperature deviation Δθ can be calculated. Accordingly, the feedback control can be executed based on the detection value of temperature sensor 230# in FIG. 1, in other words, based on the output temperature of heat exchanger 140, equivalently. Consequently, occurrence of the overshoot and the undershoot can be suppressed even when the feedback control gain (Kp and/or Ki) in controller 320# is set to be large. Since the feedback gain can be set higher in this manner, the control responsiveness with respect to set hot water temperature Tr can be improved.

Further, as shown in expression (11), as to the control arithmetic operation executed by Smith compensator 350#, the Smith compensation temperature can be calculated by the simple arithmetic operation focusing on the variation from the previous control cycle without storing each value of operation inputs (input scale numbers) from starting of the control to the present time point. Consequently, without rendering the arithmetic load and required storage capacity of control apparatus 200 to be too large, the hot water temperature control of the hot water supply apparatus applied with the Smith method can be executed.

In the present embodiment, the hot water temperature control executed by the feedback control applied with the Smith method was described. However, the hot water temperature control in further combination with the feedforward control can also be employed. In this case, input scale number uff[n] can be calculated by the feedforward control in accordance with the following expression (14) based on set hot water temperature Tr, inflow water temperature Tc, and flow rate Q.

$$uff[n]=(Tr[n]-Tc[n])/25\times Q[n] \quad (14)$$

Then, a sum of uff[n] by the feedforward control and input scale number u[t] by the feedback control calculated in accordance with expression (13) may be set as a final input scale number exhibiting requested heat quantity generation to hot water supply apparatus 100.

Further, in the present embodiment, gas burner 130 was illustrated as a "heat source mechanism" generating a heat quantity for heating water in hot water supply pipe 110. Description is made to confirm that application of the present invention is not limited to such configuration. In other words, as long as the generated heat quantity can be controlled in accordance with the requested heat quantity generation (input scale number) set by control apparatus 200, any "heat source mechanisms" can be employed. For example, in place of the gas burner, any heat sources such as an oil burner combusting oil or a heat pump mechanism can be employed.

In the present embodiment, the configuration provided with bypass pipe 120 as a typical example of causing dead time L was illustrated as a typical example of limitation of a location where a temperature sensor for detecting a tapping temperature is detected. Description is made to confirm that application of the present invention is not limited to such configuration. In other words, even in a hot water supply apparatus not provided with the bypass pipe, a similar effect can be achieved with use of a feedback control applying the Smith compensation described above as long as it is the system causing a dead time in the temperature detection.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A hot water supply apparatus, comprising:

a heat exchanger configured to heat passing water by means of a heat quantity generated by a heat source mechanism;

a temperature detector arranged on a downstream side of said heat exchanger;

a flow rate detector for detecting a passing flow rate of said heat exchanger; and a control apparatus for controlling at each predetermined control cycle the heat quantity generated by said heat source mechanism based on a tapping temperature detected by said temperature detector and a set temperature of the tapping temperature, said control apparatus including:

a temperature estimating unit for estimating for each of said control cycle a compensation temperature for compensating for a detection lag of a tapping temperature by said temperature detector with respect to an output temperature of said heat exchanger; and a feedback control unit for setting a requested heat quantity generation to said heat source mechanism based on a temperature deviation which is calculated by correcting a deviation between a tapping temperature detected by said temperature detector and said set temperature with use of said compensation temperature, said temperature estimating unit being configured to set a time constant of a first order lag of a change in said compensation temperature with respect to a change in said requested heat quantity generation in accordance with said passing flow rate detected by said flow rate detector, and calculate said compensation temperature for a next control cycle based on said compensation temperature, said requested heat quantity generation, and said set time constant which are at a present control cycle.

2. The hot water supply apparatus according to claim 1, wherein said temperature estimating unit is configured to perform arithmetic operation of decreasing said compensation temperature used in said present control cycle in accordance with said time constant and perform arithmetic operation of calculating variation in an output temperature of said heat exchanger generated by requested heat quantity generation of said present control cycle in accordance with said time constant to thereby calculate said compensation temperature for said next control cycle.

3. The hot water supply apparatus according to claim 2, wherein said control apparatus further includes a storage unit for storing characteristics, which is set in advance, of said time constant with respect to said passing flow rate, and said temperature estimating unit is configured to set said time constant in accordance with the characteristics stored in said storage unit based on said passing flow rate in said present control cycle.

4. The hot water supply apparatus according to claim 3, wherein said storage unit is switched for each kind of said hot water supply apparatus.

5. The hot water supply apparatus according to claim 1, wherein said control apparatus further includes a storage unit for storing characteristics, which is set in advance, of said time constant with respect to said passing flow rate, and said temperature estimating unit is configured to set said time constant in accordance with the characteristics stored in said storage unit based on said passing flow rate in said present control cycle.

6. The hot water supply apparatus according to claim 5, wherein said storage unit is switched for each kind of said hot water supply apparatus.

7. A control method of a hot water supply apparatus including a heat exchanger configured to heat passing water by means of a heat quantity generated by a heat source mechanism, comprising the steps of:

detecting a passing flow rate of said heat exchanger;

detecting a tapping temperature based on an output of a temperature detector arranged on a downstream side of said heat exchanger;

estimating for each of a control cycle a compensation temperature for compensating for a detection lag of said tapping temperature by said temperature detector with respect to an output temperature from said heat exchanger;

calculating for each of said control cycle a temperature deviation by correcting a deviation between a set temperature of said tapping temperature and a detected temperature by said temperature detector with use of said compensation temperature; and setting for each of said control cycle the requested heat quantity generation to said heat source mechanism based on said temperature deviation, said step of estimating including the steps of:

setting a time constant of a first order lag of a change in said compensation temperature with respect to a change in said requested heat quantity generation in accordance with the detected passing flow rate; and calculating said compensation temperature for a next control cycle based on said compensation temperature, said requested heat quantity generation, and said set time constant which are at a present control cycle.

8. The control method of a hot water supply apparatus according to claim 7, wherein in said step of calculating said compensation temperature, said compensation temperature for said next control cycle is calculated by performing arithmetic operation of decreasing said compensation temperature used in said present control cycle in accordance with said time constant and arithmetic operation of calculating variation in an output temperature of said heat exchanger generated by the requested heat quantity generation of said present control cycle in accordance with said time constant.

* * * * *